US007921688B2

(12) United States Patent
Wang et al.

(10) Patent No.: US 7,921,688 B2
(45) Date of Patent: Apr. 12, 2011

(54) SQUARE TUBE FORMING ROLL, SQUARE TUBE FORMING METHOD, AND FORMING DEVICE

(75) Inventors: Feizhou Wang, Osaka (JP); Tomoyasu Nakano, Osaka (JP); Manabu Kiuchi, Zushi (JP)

(73) Assignee: Nakata Manufacturing Co., Ltd., Osaka (JP)

( * ) Notice: Subject to any disclaimer, the term of this patent is extended or adjusted under 35 U.S.C. 154(b) by 654 days.

(21) Appl. No.: 11/719,841

(22) PCT Filed: Dec. 27, 2004

(86) PCT No.: PCT/JP2004/019825

§ 371 (c)(1), (2), (4) Date: Aug. 15, 2007

(87) PCT Pub. No.: WO2006/057074

PCT Pub. Date: Jun. 1, 2006

(65) Prior Publication Data

US 2008/0302160 A1 Dec. 11, 2008

(30) Foreign Application Priority Data

Nov. 26, 2004 (JP) ..... 2004-341516

(51) Int. Cl.
*B21B 13/12* (2006.01)
*B21C 37/30* (2006.01)

(52) U.S. Cl. ..... 72/225; 72/235; 72/252.5; 72/370.26

(58) Field of Classification Search ..... 72/224–226, 72/234, 235, 252.5, 367.1, 370.23, 370.24, 72/370.26, 31.06
See application file for complete search history.

(56) References Cited

U.S. PATENT DOCUMENTS 3,347,078 A 10/1967 Keska et al.
4,311,033 A * 1/1982 Demny et al. ..... 72/224
5,423,201 A * 6/1995 Steinmair et al. ..... 72/225

FOREIGN PATENT DOCUMENTS

JP 61037321 A * 2/1986

(Continued)

OTHER PUBLICATIONS

European Office Action mailed Apr. 29, 2010 for the corresponding European Application No. 04808175.6.

(Continued)

*Primary Examiner* — Debra M Sullivan
(74) *Attorney, Agent, or Firm* — Leason Ellis LLP.

(57) ABSTRACT

Roll forming a round tube to a square tube without applying excessive load to the raw tube scheduled portions to become corner portions and shoulder portions. This invention structures the curvature of the rotation axis direction of the forming roll surface in a way that in relation to other raw tube locations (straightening precedes for the raw tube locations adjacent to the corner portion scheduled locations of the square tube. It disposes stands of four-direction roll structure at the forming roll stand furthest upstream and furthest downstream sides and disposes stands of upper-lower and left-right two-direction roll structure between the upstream and downstream roll stands, and by adopting forming roll with a structure having a curvature for constricting the raw tube locations to become the shoulder portions adjacent to the corner portions of the square tube at a smaller curvature than that constricting the raw tube portions to become the side portion centers of the square tube cross section.

4 Claims, 8 Drawing Sheets

FOREIGN PATENT DOCUMENTS

| | | | |
|---|---|---|---|
| JP | 61-046305 | | 3/1986 |
| JP | 3-285713 | A | 12/1991 |
| JP | 5-212440 | | 8/1993 |
| JP | 6238308 | | 8/1994 |
| JP | 6-262253 | | 9/1994 |
| JP | 10-258311 | A | 9/1998 |
| JP | 11-156435 | A | 6/1999 |
| JP | 2000-301233 | A | 10/2000 |
| JP | 2000-301233 | A | 10/2000 |

OTHER PUBLICATIONS

Japanese Office Action mailed Dec. 7, 2010 for the corresponding Japanese Application No. 2004-341516.

* cited by examiner

SQUARE TUBE FORMING ROLL, SQUARE TUBE FORMING METHOD, AND FORMING DEVICE

CROSS REFERENCE TO PRIOR APPLICATION

This is a U.S. national phase application under 35 U.S.C. §371 of International Patent Application No. PCT/JP2004/019825 filed Dec. 27, 2004, and claims the benefit of Japanese Application No. 2004-341516 filed Nov. 26, 2004 all of which are incorporated by reference herein. The International Application was published in Japanese on Jun. 1, 2006 as International Publication No. WO 2006/057074 under PCT Article 21(2).

TECHNICAL FIELD

In relation to forming rolls and pursuant forming methods and devices for re-forming of round tubes to square tubes, this invention is related to square tube forming rolls achieving multi-use implementation for forming rolls and to roll forming methods and forming devices for square tubes.

BACKGROUND OF THE INVENTION

Many structures are proposed that have forming methods and devices utilizing forming rolls to re-form round tubes of circular cross section to square tubes of square or rectangular cross section as the primary means for manufacturing square tubes.

For example, in describing the structure which displays the concept for the most general forming method (refer to the disposition of forming rolls in FIG. 6), there are utilized multiple so-called four-direction roll forming stands composed of one pair of upper-lower forming rolls and one pair of left-right forming rolls for which the rotation axes are disposed identically to the raw tube cross sectional, straightening of the raw tube portions is by pressing from four directions the rolls against the raw tube locations that correspond to the side portions of the final product, and allowing plastic deforming of the round cross section shape to a square or rectangular cross section shape.

In addition, there is a limit for the forming amount of any single stage of four-direction roll forming stand, so to reduce the number of forming rolls expected for control and equipment costs, generally, there are disposed 3~4 stages of the above described forming stands along the axis direction of the raw tube, and there is caused successive deforming of the raw tube cross section shape.

On the other hand, in Japanese Laid-Open Patent Application No. 2000-301233, another roll forming device and forming method are disclosed as a means of re-forming for square tubes. With this forming means (see FIG. 7), the roll rotation axis of an upper-lower forming roll pair and the roll rotation axis of a left-right forming roll pair are disposed at differing raw tube cross sections. Accordingly, no reciprocal interference is present for any roll position adjustment, and, in addition, even with forming rolls having a single curvature in the rotation axis direction, it is possible to support differing product dimensions by utilizing such position adjustment, and there is easy adaptation to automated and NC processes.

Furthermore, for the purpose of simplifying forming devices, there are also offered devices (see FIG. 8) that cause plastic deforming of a round cross section shape by using multiple forming rolls having forming surfaces of a V-shaped concave portion only in two-directions substitutionally for four-direction roll stands, but there are easily generated problems for product surface damage due to excessive roll surface speed differences and problems for product shape symmetry, so this is limited to small-sized products where the forming rolls are sufficiently larger than the raw tube outside diameter, and it is not a general-purpose method. In addition, similarly to four-direction roll stands, there is little joint use of rolls for differing product dimensions.

Patent Citation 2: Japanese Laid-Open Patent Application No. H5-212440

Patent Citation 3: Japanese Laid-Open Patent Application No. H6-262253

Through the results of earnest investigation of former roll forming structures, the inventors recognized that adopting of shapes with a single arc having a fixed radius (R) in the rotation axis direction became a causal factor not only for problems related to dimensional accuracy, such as irregularities in the curvature of corner portions and degenerated flatness of side portions for square tubes following forming, but also for inviting insufficiencies of rigidity for square tube products due to excessive deforming in corner portions (see "a" of FIG. 4A and "A" portion of FIG. 4B) and side portions adjacent to corner portions (hereafter referred to as "shoulder portions"; see "b" of FIG. 4A and "B" of FIG. 4B), and that these problems easily generated destruction, etc., for these same locations.

In addition, the forming means disclosed in Japanese Laid-Open Patent Application No. 2000-301233 was developed as an effort to reliably apply multi-use implementation of rolls, but the inventors recognized that the previously described problems were not essentially eliminated because the curvature of the roll caliber in each roll was a single curvature or a straight line shape.

Furthermore, when considering forming raw tubes of various cross section curvatures using rolls with which each has a single caliber curvature, for example, when the curvature radius of the roll caliber is set to enable use in forming of raw tubes having a large cross section curvature radius, the curvature radius of the roll caliber becomes excessive for a raw tube having a small cross section curvature radius.

Accordingly, at use of the described roll caliber for a raw tube having small cross section curvature radius, when the forming amount is excessively large at a single stage due to the difference of those curvatures, indentation is easily generated in the side portions of the product and the flatness of the product is adversely affected.

To alleviate or eliminate this problem, it is necessary to divide the dimensions range for all products into multiple stages and to prepare each roll caliber corresponding to each raw tube dimension range. Described differently, when the products dimension range is wide, it is necessary to prepare rolls and forming stages of correspondingly greater number. This effect increases equipment costs, and effect of roll multi-use implementation becomes limited.

On the other hand, while the means of forming by establishing multiple stages of upper-lower forming roll pairs and left-right forming roll pairs is general-purpose, from the perspective of reducing equipment costs, there is strongly sought a means of reducing to the greatest extent the number of these forming stages. Moreover, it becomes necessary for equipment design to consider easy facilitation of preservation and maintenance control for the equipment.

SUMMARY OF THE INVENTION

The purpose of this invention is to offer square tube forming rolls and a roll forming device and forming method for square tubes that eliminates the previously described problems recognized by the inventors, performs roll forming of round tubes to square tubes without applying an excessive load to the raw tube in such as scheduled portions to become corner portions and shoulder portions, and manufactures square tubes having highly accurate dimensions and shape as well as excellent quality with the raw materials having thick sections with multi-use implementation of rolls and at lower cost.

To achieve the above stated purpose, forming rolls for square tube use according to this invention are forming rolls used in a device for successively forming a raw tube of round tube with circular cross section to a square tube of square cross section or rectangular cross section by upper-lower forming roll pairs and left-right forming roll pairs disposed with rotation axes within a plane that includes a cross section of the raw tube, and are characterized by structuring the curvature of the rotation axis direction of the forming roll surface so that straightening of raw tube locations (shoulder portion scheduled locations) adjacent to the corner portion scheduled locations of the square tube is advanced in relation to other raw tube locations (other side portion scheduled locations).

Adopting of this structure makes possible in the initial stage of the forming process easy application of sufficient moment to the bend of the raw tube locations to become shoulder portions, and enables performance to a nearly complete extent the straightening of the raw tube location. Accordingly, because constriction of the circumferential direction and localized rolling/compression of the shoulder portions at the time of square tube forming are strikingly reduced, reproducibility of the curvature of the corner portions and improvement in the flatness of the side portions can be expected for the obtained product, residual stress and process hardening in the final product are reduced, and generation of damage such as indentations and scratches is reduced.

To describe the structure of the roll caliber that is the essence of this invention differently, the forming rolls for square tube use according to this invention are characterized by the curvature constricting the raw tube locations to become the shoulder portions in the square tube cross section being smaller than the curvature constricting the raw tube portions to become the side portion centers of the square tube cross section, for those curvatures of the rotation axis direction of the forming roll surface. Of course, the operational effect obtained by the expressed structure is entirely identical to the forming rolls of the former structures previously expressed.

In addition, with this invention, it is acceptable if the curvature of the rotation direction of the described forming roll surface is continuously or consecutively smaller facing both outer directions from the position that constricts the raw tube locations to become the side portion centers. Regarding the circumferential surface shape of the forming roll, the curvature need not be divided simply into two stages, but by selecting so as to modify the curvature consecutively or continuously, it is possible to always cause the straightening of the raw tube locations to become shoulder portions to precede that of other locations, even when implementing multi-use of rolls for forming of differing product sizes.

The above described forming method and forming device for square tubes of this invention is characterized by utilizing:

(1) Forming rolls structured of a curvature of the rotation axis direction of the forming roll surface so that straightening of the raw tube locations to become shoulder portions adjacent to the corner portions precedes that of the raw tube locations to become other portions of the square tube side portions;

(2) Forming rolls of a structure in which the curvature that confines the raw tube regions where (the raw tube locations) to become the shoulder portions adjacent to the corner portions of the square tube is smaller than the curvature constricting the raw tube locations to become the side portion centers of the square tube surface among those curvatures of the forming roll surface, along the roll rotation axis;

(3) Forming rolls of a structure in which the curvatures of the rotation axis direction of the forming roll surface become continuously or consecutively smaller facing both outer sides from the locations constricting the raw tube locations to become the side portion centers of the square tube cross section.

With the forming method and forming device of this invention, it is possible from the initial stage of forming with the utilized rolls to perform straightening by applying sufficient bending moment to the raw tube locations to become shoulder portions. Therefore, according to the forming method of this invention, the result is reduction of problems of insufficient rigidity in the corner portions and shoulder portions, improvement of reproducibility of the curvature of the corner portions and flatness of the side portions of the obtained square tube, and reduction of indentations and scratches in the finished product, without remarkably generating at time of square tube forming the constriction of the circumferential direction and localized rolling/compression of the shoulder portions as with former methods.

In addition, the forming method for square tubes according to this invention is characterized by including a process forming the raw tubes by structuring the forming rolls of this invention in so-called four-direction rolls, specifically, a process forming the square tube by utilizing the forming rolls of a structure described in above points and disposed so that the rotation axis of each roll for each upper-lower forming roll pair and left-right forming roll pair is within a plane that includes a single raw tube cross section, and by including a process forming the raw tube by structuring the forming rolls of this invention in so-called alternating two-direction roll pairs, specifically, a process forming the raw tube by utilizing forming rolls of a structure described in above points and disposed so that each roll rotation axis of the upper-lower forming roll pair and the left-right forming roll pair is within a plane that includes a raw tube cross section differing for each roll pair.

With this invention, it is possible to adopt a method forming square tubes with process patterns of variously combined forming processes according to need. For example, a process structure can adopt a four-direction roll process forming raw tubes by structuring the forming rolls of this invention in a so-called four-direction roll at the first and last stage of the formation process and can insert an alternating two-direction process forming the square tubes by structuring the forming rolls of this invention in so-called alternating two-direction rolls between those outer stage processes.

In addition, the forming method for square tubes according to this invention can adopt a combination of various processes according to various purposes, such as adopting alternating two-direction roll processes and a described four-direction roll processes combining various processes formerly known (various known forming roll stands) and inserting known processes (devices) in the process pattern of the invention described above.

Further, regarding the forming method for square tubes according to this invention, when there is included a process forming a raw tube by structuring the forming rolls of this invention in so-called alternating two-direction rolls, it is possible to increase efficiency of the process by applying heat to the raw tube locations to become the corner portions of the square tube cross section prior to the re-forming process.

The square tube forming device according to this invention is characterized by a roll forming line that has disposed at each necessary stage expected for producing the various selected process pattern each forming roll stand of the four-direction roll structure and two-direction roll structure having embodied a process forming the raw tube by structuring the forming rolls of this above described invention in so-called four-direction rolls and a process forming the raw tube by structuring the forming rolls in so-called alternating two-direction rolls.

For example, it is possible to adopt various stand combinations, such as a device structure that adopts four-direction roll stands structured by the forming rolls of this invention at the first stage and last stage of the re-forming device and disposing single or multiple two-direction roll stands structured by the forming rolls of this invention between those first and last stages. In addition, with the square tube forming device according to this invention, it is possible to adopt a structure that has provided a heating means for applying heat in advance to the raw tube locations to become the corner portions of the square tube cross section, prior to forming by the forming roll stands.

Furthermore, forming devices providing forming roll stands of multiple stages are general purpose, but of these, there may be instances of spare forming stands established for the purpose of ensuring exact roundness of the raw tube in advance and increasing the drive force. However, because these would not to contribute directly to square tube forming, they are not counted with the forming stages of the square tube forming process in this invention.

With the forming method and the forming device adopting the forming rolls of this invention, it is possible to remarkably reduce dependence on constriction of the circumferential direction and localized rolling/compression at the process last stage for finishing the target product shape and dimensions by having straightening of the raw tube locations to become the shoulder portions adjacent to the corner portions of the square tube precede the other raw tube locations at the initial stage of the re-forming process for square tubes. This result alleviates the problem of insufficient rigidity or toughness in the corner portions and adjacent locations, improves the reproducibility of the curvature of the corner portions and the flatness of the side portions for the obtained square tube, and reduces indentations and scratches in the final product.

Aside from the results described above, there is by this invention superior effect for the forming means disclosed in Japanese Laid-Open Patent Application No. 2000-301233. Specifically, by structuring the caliber curvature of the square tube forming rolls of this invention, there is elimination of the problem of compatibility with single caliber curvature radius and differing raw tube diameters in above described roll multi-use implementation, the necessity of former method countermeasures for supporting each roll assembly by dividing the dimensions range for all products into multiple groups is eliminated, and the numbers of forming rolls and the forming stages are greatly reduced.

In addition, when using the two-direction roll structure of this invention, at forming by the raw tube cross section being pressed downward by rolls from upper-lower or left-right directions, because there is strong tendency to generate bending return by expansion to the outer sides of other raw tube locations not being constricted, in comparison to when using the former four-direction roll structure, corner portion control can be more difficult and forming efficiency for side portions is degraded, and it is necessary to carefully perform successive forming by utilizing more forming stages.

With this invention, by structuring the process for various patterns combining four-direction structures and two-direction structures, there is an effort to provide optimum balance between roll multi-use effect and equipment costs. For example, there can be disposed a forming stand of the four-direction structure at the initial stage of the forming process, and after reliably determining the positions of the corner portion scheduled locations, by establishing forming stands of the two-direction structure it is possible to raise the forming efficiency of the two-direction structures. In addition, by disposing a forming stand of the four-direction structure at the final stage of the forming process, finishing of the corner portion shapes and dimensions is performed more reliably, and it is possible to greatly reduce the forming stages of the entire device body.

In addition, as one additional measure for raising the forming efficiency of the two-direction roll structures, with this invention, after applying heat to the raw tube locations to become the corner portions of the square tube cross section in advance of the described square tube re-forming process, there can be adoption of a process forming the raw tube by structuring the forming rolls of this invention in two-direction rolls. Because the heat is applied locally to the raw tube locations to become corner portions and this reduces deforming resistance in comparison to other raw tube locations, there is suppression of the phenomenon for bending return of raw tube locations not being constricted by forming with two-direction rolls, and dependence on four-direction roll stands is decreased in comparison to forming without heating, which enables further reduction of the number of four-direction roll stands that require roll exchange.

Further, because forming occurs after applying heat to the corner portion scheduled locations in advance, along with eliminating residual response of the raw tube and the process hardening history, there is effective suppression of process hardening and residual response by the re-forming process, and this enables manufacture square tube products with higher quality.

DETAILED DESCRIPTION OF THE INVENTION

Figure 9:
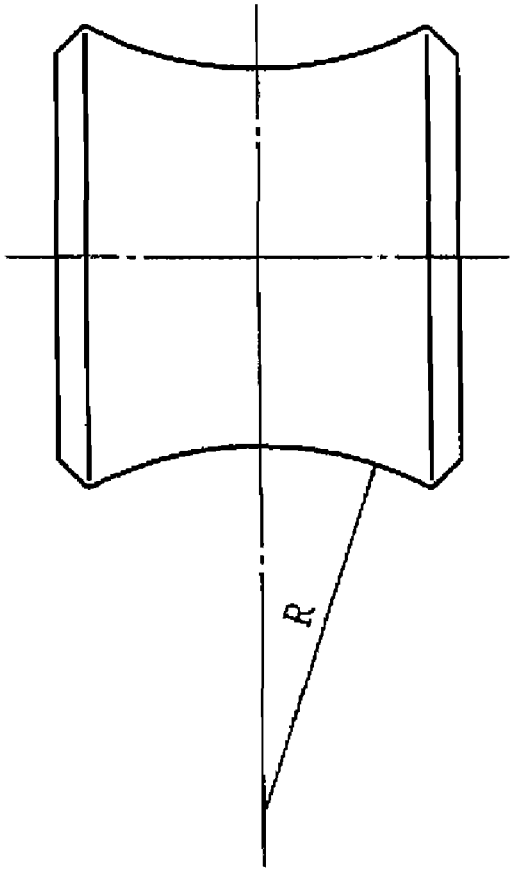
FIG. 9 is a plane view drawing of a forming roll possessing a circumference shape composed of a single curvature of the former method.

The inventors noticed the adoption of a shape in a single arc having fixed curvature (R) in relation to the rotational axis direction as shown in FIG. 9 in the portion forming the circumferential surface shape of the forming roll, which is called a roll caliber, for the square tube forming device of the former method, including of any of the previously described former methods.

Figure 4B:
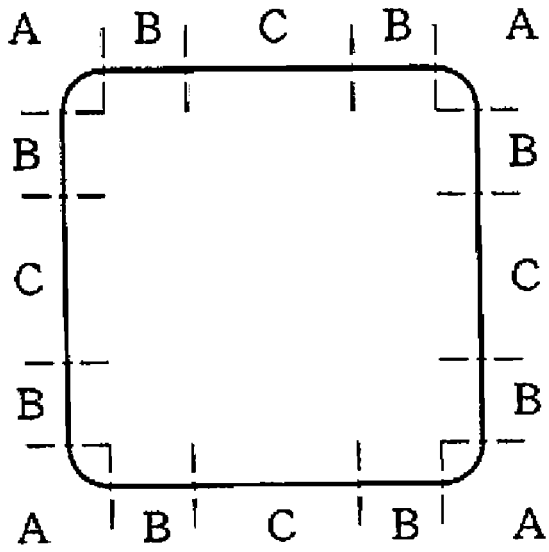
FIG. 4B is an explanatory drawing showing each location of a square tube, in which a~c and A~C correspond to locations of the raw tube and square tube.
Figure 4A:
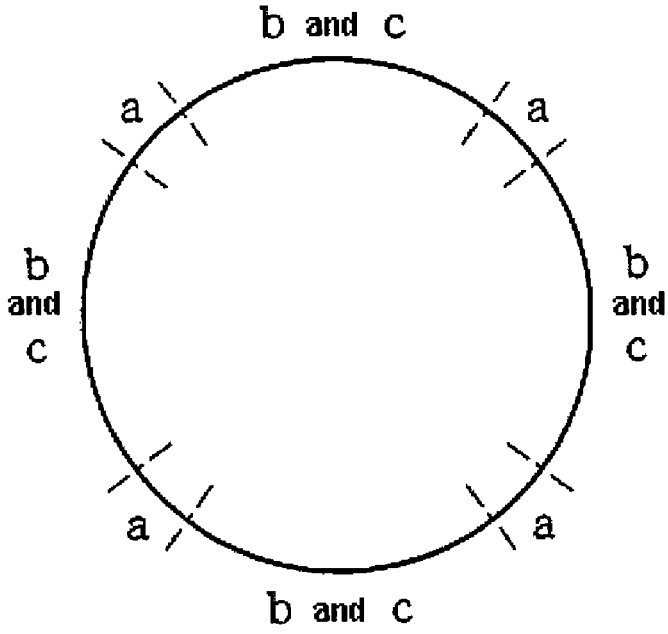
FIG. 4A is an explanatory drawing showing locations of a raw tube.

Specifically, when using forming rolls as with the former methods, the straightening of the raw tube portions to become each portion of the side portions of the square tube at each stage of the forming process is performed successively at an identical pace, but at the final stage of the process at which is performed finishing of the corner portions (FIG. 4A "a" and FIG. 4B "A") and side portions, in the side portions (FIG. 4A "b" and FIG. 4B "B") adjacent to the corner portions, because there is not sufficient obtaining of bending moment required for straightening in comparison to the center portions of the side portions (FIG. 4A "c" and FIG. 4B "C"), the target final shape, and especially the required dimensions the corners and the adjacent portions, is obtained by causing constriction of the circumferential direction and localized compression rolling of the shoulder portions.

Regarding the related roll forming structure, the inventors recognized that not only were there problems in dimensional accuracy, such as in deterioration of flatness of the side portions and irregularities of the curvature of the corner portions in the square tube after forming, but there were also problems in inviting insufficient rigidity or toughness of the square tube products due to excessive deforming in the corner portions and shoulder portions, and in easily generating problems such as damage in those locations.

To solve these problems, with this invention, the forming rolls are characterized by structuring a curvature of the rotation axis direction of the forming roll surface such that straightening of the raw tube locations (shoulder portion scheduled locations) adjacent to the corner portion scheduled locations of the square tube precedes in comparison to other raw tube locations (other side portion scheduled locations).

Hereafter, this section describes a form of execution of the invention based on the drawings. Furthermore, identical symbols are attached and explanations are not repeated for identical or corresponding parts between the drawings.

Figure 1:
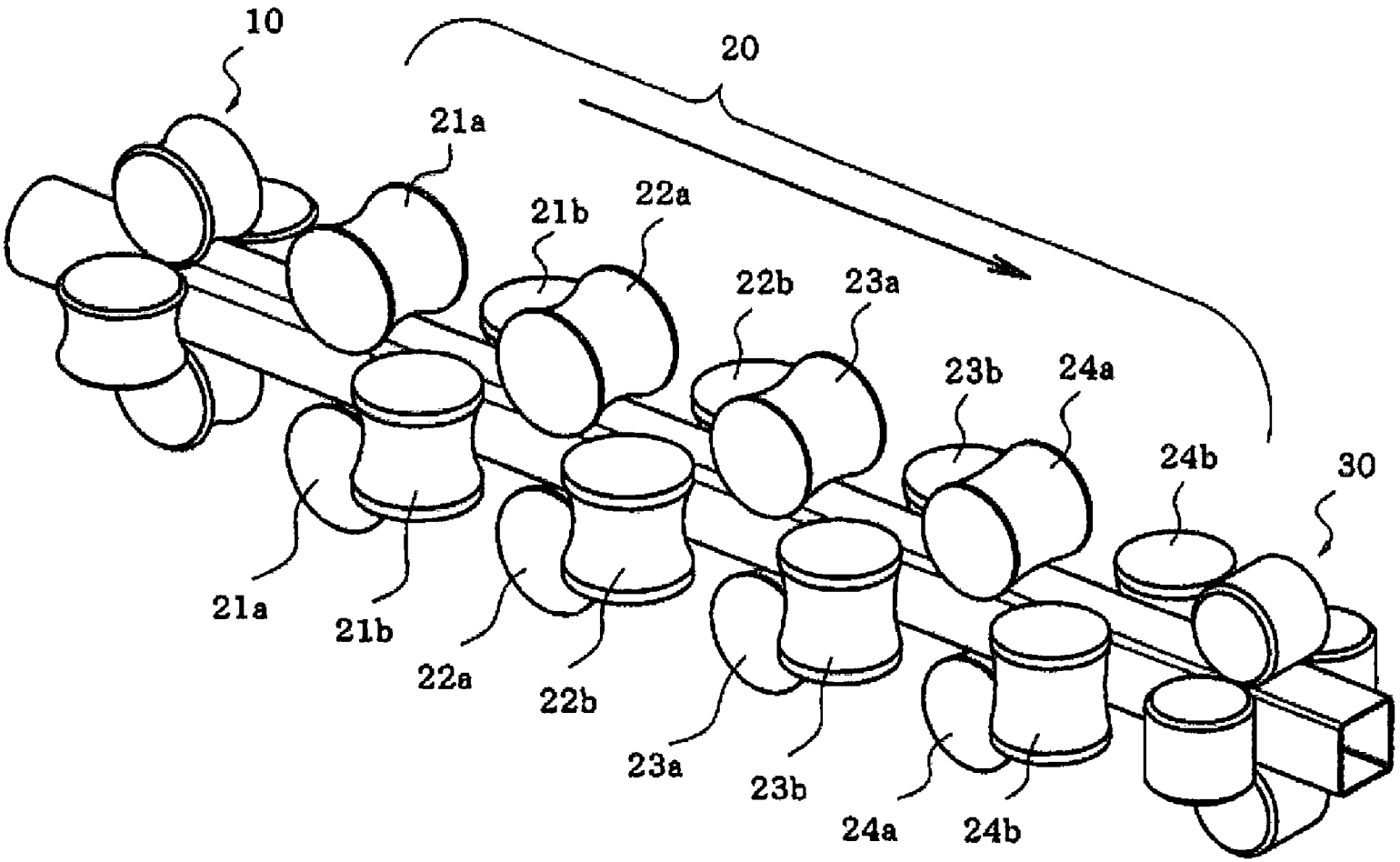
FIG. 1 is a perspective view drawing showing an abbreviated approximate structure of the square tube forming device related to an embodiment of this invention.

FIG. 1 is a drawing that displays a perspective view of an embodiment of the square tube forming device of this invention. The square tube forming device of this embodiment is structured from ten stages of forming rolls. Of these, forming roll stand 10 (hereafter, the furthest upstream side forming roll stand) performs initial forming of the raw tube and forming roll stand 30 (hereafter, the furthest downstream side forming roll stand) performs final forming of the raw tube, and they are stands of so-called four-direction roll structure arranging each roll rotation axis of the pair of upper-lower forming roll pair and left-right forming roll pair within a plane that includes a single raw tube cross section.

On the other hand, forming roll stand 20 disposed between the furthest upstream side forming roll stand 10 and the furthest downstream side forming roll stand 30 is structured of four stages composed of upper-lower forming roll pairs 21*a* through 24*a* and four stages composed of left-right forming roll pairs 21*b* through 24*b*, and the roll rotation axis of each of these stands within forming roll stand 20 is disposed within a plane that includes a differing raw tube cross section, and is a forming roll stand of the so-called two-direction roll structure. Then, upper-lower forming roll pairs 21*a* through 24*a* and left-right forming roll pairs 21*b* through 24*b* are disposed to alternate at prescribed intervals. Furthermore, though not shown in the drawing, each forming roll is driven by a widely known drive device.

Figure 2:
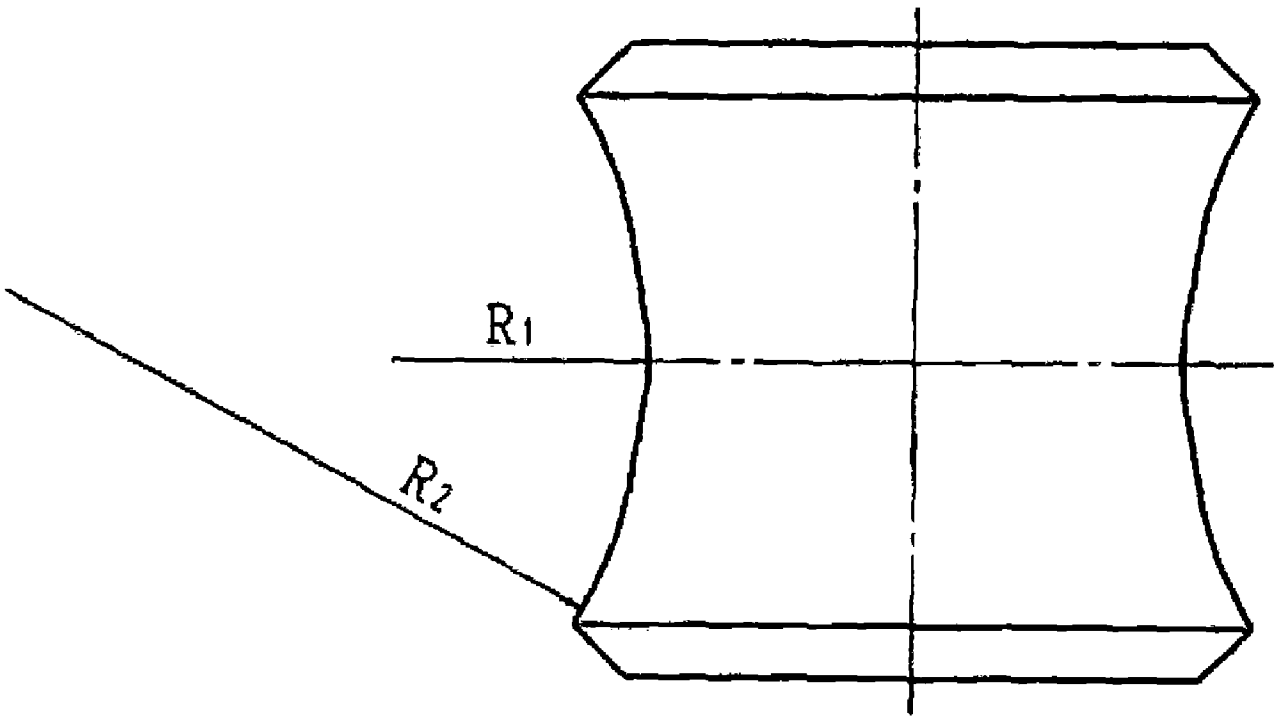
FIG. 2 is a plane view drawing of a forming roll possessing a circumference shape composed of two curvatures of this invention.

Then, for all of the described forming rolls, the curvature of the rotation axis direction of the roll surface is structured so that straightening of the raw tube locations to become shoulder portions by the roll precedes the other raw tube locations. For example, as shown in FIG. 2, within the curvatures of the rotation axis direction of the forming roll surface, the curvature constricting the raw tube locations to become shoulder portions adjacent to the corner portions of the square tube is smaller than the curvature constricting the raw tube locations to become the side portion centers of the square tube cross section.

Figure 3:
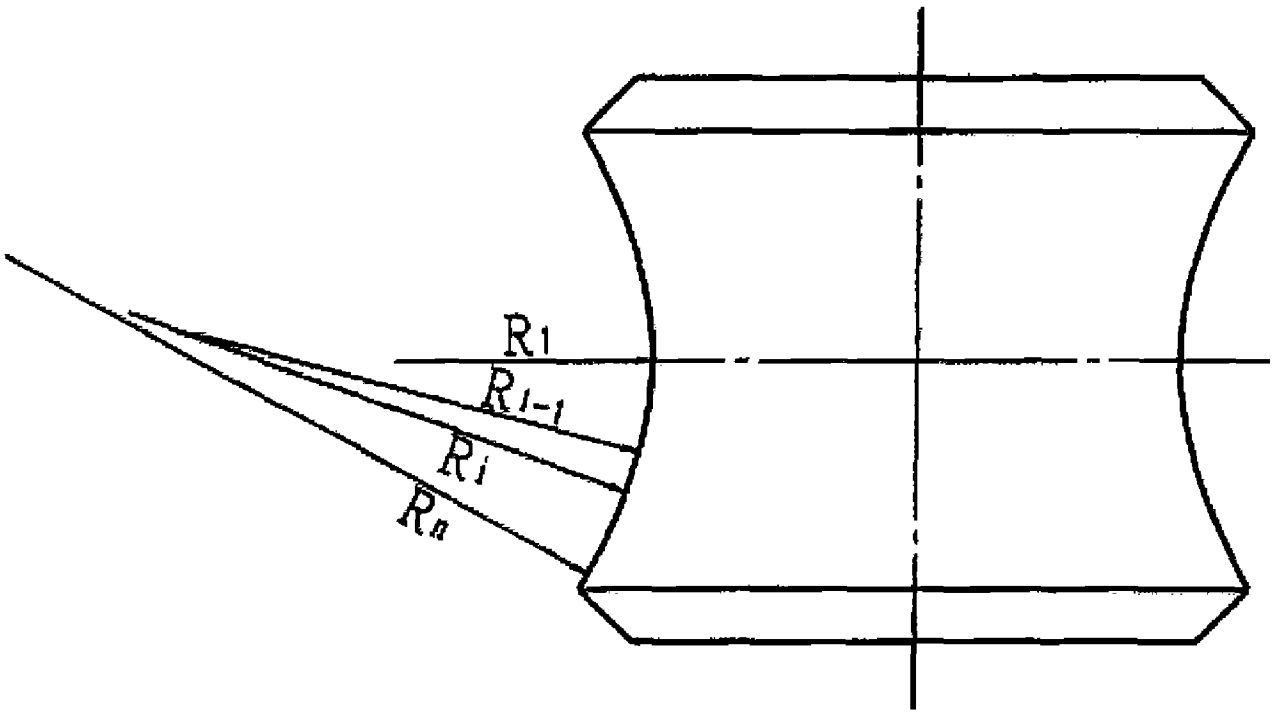
FIG. 3 is a front view drawing of one example of a forming roll possessing a circumference shape composed of three or more curvatures of this invention.

Regarding forming rolls, as a more preferred form, the curvature of the rotation axis direction of the forming roll surface as shown in FIG. 3 can utilize a forming roll that becomes continuously or consecutively smaller facing both outer sides from the location constricting the raw tube location to become the side portion center of the square tube cross section. Curvature radii R1, Ri . . . Rn within the drawing are suitably selected according to such as the outside diameter range and material properties of the raw tubes to be formed.

Furthermore, forming roll stands 10 and 30 of total eight rolls constricting simultaneously four-directions of the raw tube are require exchanging according to the variation of a product side portion dimensions, but the two-direction forming rolls (21*a* through 24*a* and 21*b* through 24*b*) of the eight stages are all multi-use rolls. This is because the surface shape of each forming roll is structured from multiple curvatures. For example, when the raw tube outside diameter is small, because there is used a caliber portion of the roll center vicinity of small average curvature radius, the forming amount for the side portions becomes excessive and eliminates generation of indentation.

Figure 5:
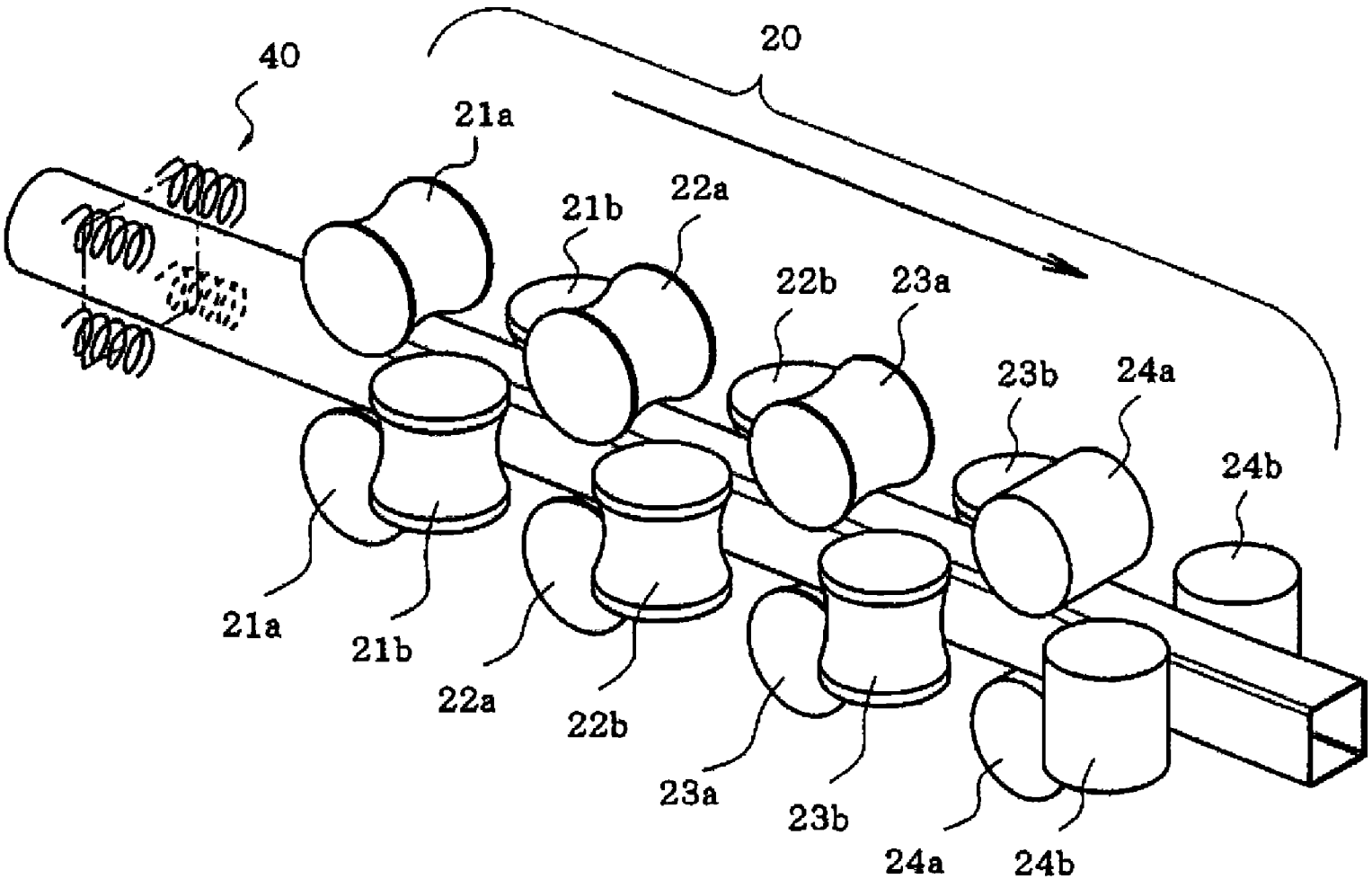
FIG. 5 is a perspective drawing showing an abbreviated structure of a square tube forming device related to another embodiment of this invention.

FIG. 5 is a drawing showing a perspective view of another embodiment of the square tube forming device of this invention. The square tube forming device of this embodiment is structured from an eight stage forming roll stand. The forming roll pairs of the eight stages are structured of four stages comprised of upper-lower forming roll pairs 21*a* through 24*a* and similarly with four stages comprising left-right forming roll pairs 21*b* through 24*b*. Then, the upper-lower forming roll pairs and left-right forming roll pairs are alternately disposed at prescribed intervals.

Moreover, all the described forming rolls used are identical to those of the previous embodiment. For example, forming rolls displayed in FIG. 2 and FIG. 3 are optimal. Further, with this embodiment, at the upstream side higher than the forming roll pairs is prepared a heating device 40 for applying heat to the raw tube locations to become the corner portions of the final square tube cross section.

Specifically, after applying heat to the raw tube locations to become the corner portions of the square tube cross section, the device forms the square tube by upper-lower two-direction roller stands and left-right two-direction roller stands having a structure identical to that of the previous embodiment. Various heating means can be considered, but it is preferable to utilize a means that allows temperature control by a control device and enables application of heat by suitable selection of a temperature range that is markedly lower than the deforming resistance value of the raw tube material. For example, this embodiment uses a mid-frequency induction heating device. This type of heating device is capable of performing heating temperature control by suitable selection of frequency and input current value according to the cross sectional surface area and forming speed for the thickness and corner portions of the product.

As shown in this embodiment, by applying heat to the raw tube locations to become the corner portions prior to the square tube re-forming process, due to great improvement of reliability for forming by the multi-use two-direction rolls, it is possible to completely eliminate or reduce the number of four-direction roll stands requiring roll exchange, and this further raises the effect of roll multi-use implementation.

Figure 6:
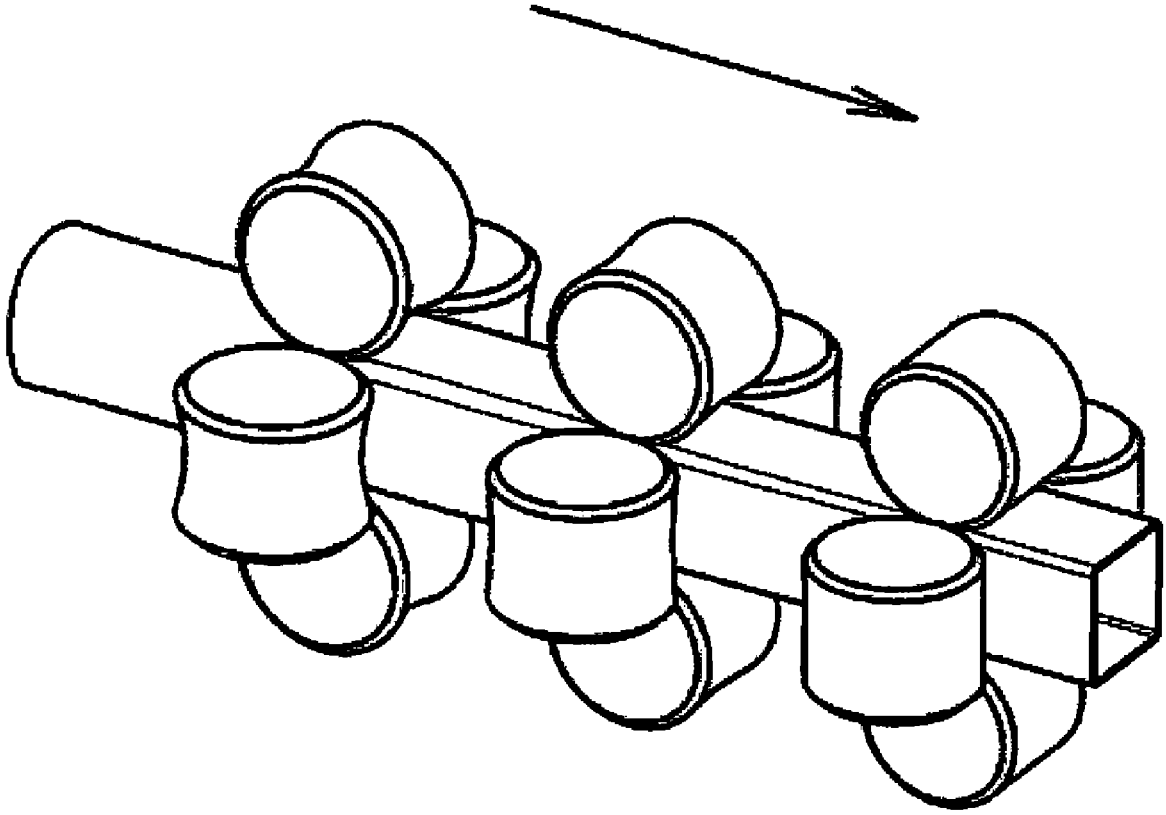
FIG. 6 is a perspective drawing showing an abbreviated structure of a square tube forming device using forming rolls possessing a circumference shape composed of a single curvature of a former method.
Figure 7:
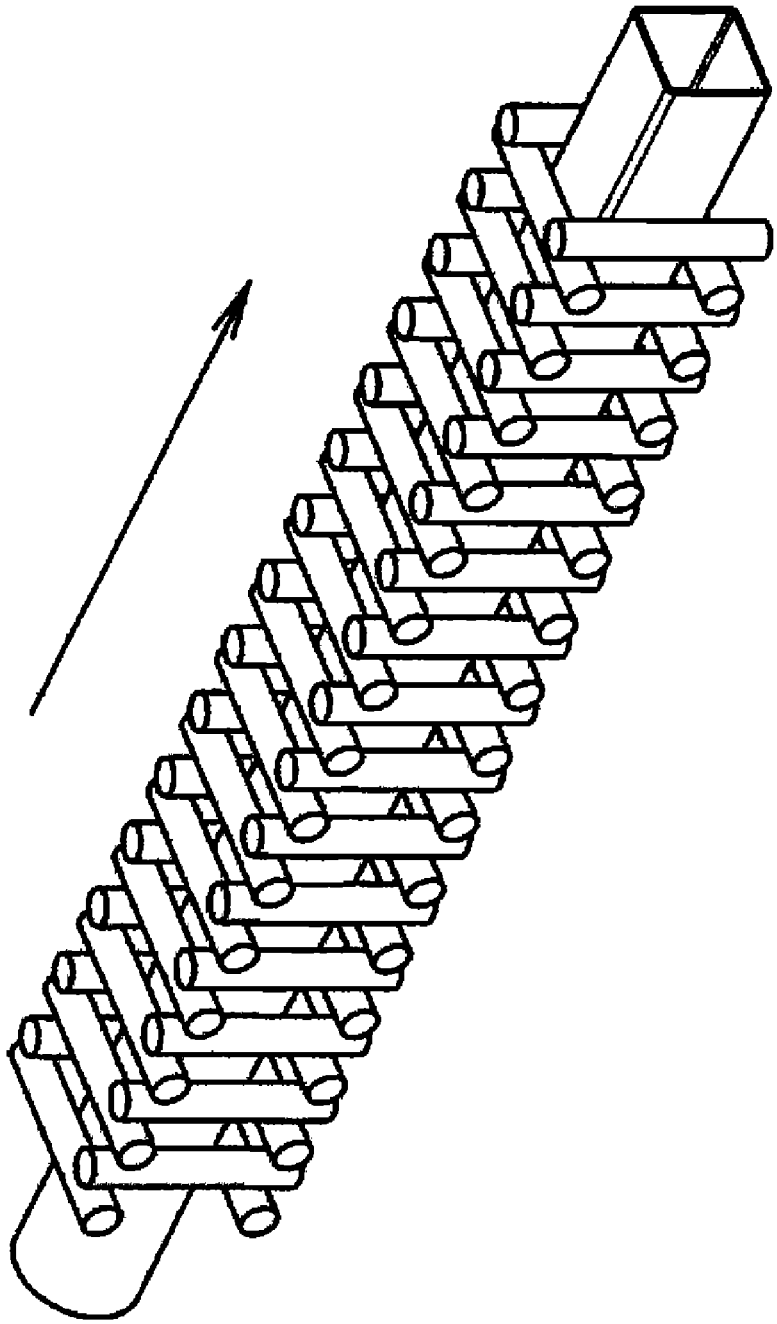
FIG. 7 is a perspective drawing showing an abbreviated structure of another square tube forming device using forming rolls possessing a circumference shape composed of a single curvature of a former method.
Figure 8:
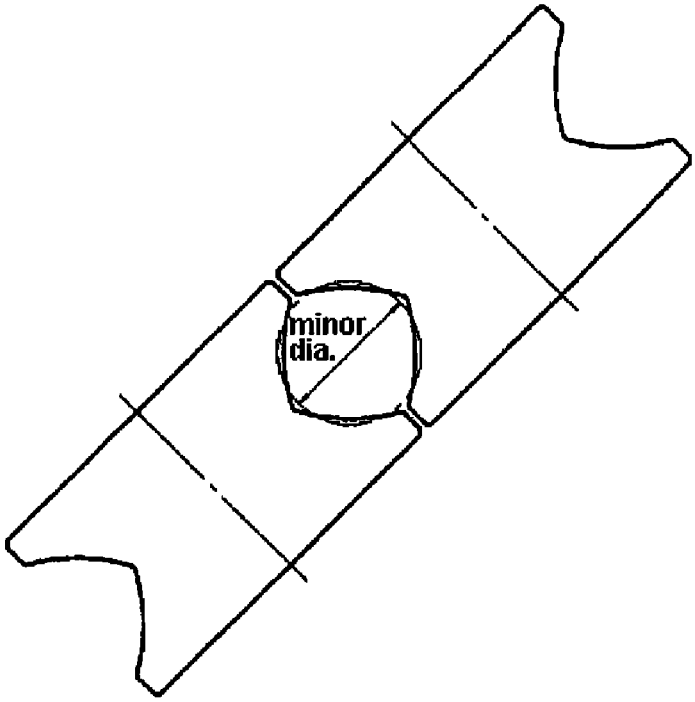
FIG. 8 is a plane view drawing of a forming roll possessing a forming surface of V-shaped concave portion of a former method.

Hereafter, the inventors show in Table 2 a comparison of the former technology described in reference to FIG. 6 and FIG. 7 to a working example for these embodiments of this invention in the performance of actual tests and numerical simulations for square tube forming under the forming conditions shown in Table 1.

Furthermore, FIG. 7 is a forming device recorded in Japanese Laid-Open Patent Application No. 2000-301233 structured only of two-direction rolls, and the surface shape of each forming roll possesses a single curvature. In addition, "Former (1)" in the table indicates use of the former technology related to FIG. 6 and "Former (2)" in the table indicates use of that related to FIG. 7. Then, "Invention (1)" is an example of Embodiment 1 of this invention, and "Invention (2)" is an example of Embodiment 2 of this invention.

The possible forming range of the forming devices includes a total of 17 types of square tube products as shown in Table 1. With the four-direction roll forming stands, because the rotation axis of each roll is disposed within the same plane, it is not possible to drive with other than either the upper-lower forming roll pair or left-right forming roll pair due to interference from the machine. Generally, only the upper-lower roll pairs are forming stands with drive, and with only these stands it is difficult to obtain drive force for assuring stabilized forming speed. For this reason, at the upstream side of the former square tube forming device composed of four-direction roll stands ("Former (1)" in Table 2) there are always established two stages of four-direction roll stands for the purpose of increasing drive force, and, with these stands, it is necessary to prepare the number of rolls corresponding to the type of dimensions of the square tube.

On the other hand, when using two-direction roll forming stands, no problem exists for the described mechanical interference, and it becomes possible to drive with both the upper-lower forming rolls and left-right forming rolls, and sufficient drive force is obtained. The effect eliminates the requirement for other forming stands as with the former method.

As shown in FIG. 2, when using "Former (1)", many forming rolls are required to cover the range of products of Table 1, and costs greatly increase. Further, roll exchange operations become a significant burden and adversely impact manufacturability. In addition, when using "Former (2)", complete multi-use implementation is possible, and this enables great reduction of the number of required forming rolls, but because a large number of forming stages are required to cover the range of products of Table 1, costs and maintenance of equipment that includes a roll position control system can be a significant burden.

On the other hand, with "Invention (1)", due to establishing of a four-direction roll stand at the furthest upstream side and furthest downstream side of the square tube re-forming process, it is necessary to prepare specialized rolls for each product dimension in these forming stands, but the number of two-direction roll stands is greatly reduced in comparison to "Former (2)", and a favorable balance in overall costs and manufacturability is obtained. In addition, with "Invention (2)", due to the application of heat to the raw tube locations to become the corner portions and subsequent decreasing of deforming resistance, it becomes unnecessary to use four-direction roll stands, and it is possible to further significantly reduce the number of forming stands and forming rolls, enabling an increase in manufacturability.

Furthermore, the raw tube diameters required for forming of square tube products of identical dimensions are confirmed to be reduced by 1.0~2.0% for the product dimensions when using "Invention (1)" and "Invention (2)" in comparison to "Former (1)" and "Former (2)". This is due to alleviation of constriction against the raw tube during forming and rolling phenomena through utilizing of the forming rolls and forming method of this invention.

TABLE 1

| Raw Tube Outer Diameter | Product Outer Dimensions mm (Product Thickness t Range 3.0 mm~16.0 mm) | |
|---|---|---|
| Round Tube Diameter mm | Square-Shaped Square Tube | Rectangular-Shaped Square Tube |
| 157.3 | 125 × 125 | 150 × 100 |
| 189.3 | 150 × 150 | 200 × 100 |
| 253.3 | 200 × 200 | 250 × 150 |
| | | 300 × 100 |
| 316.2 | 250 × 250 | 300 × 200 |
| | | 350 × 150 |
| 380.1 | 300 × 300 | 350 × 250 |
| | | 400 × 200 |
| | | 450 × 150 |
| 441.2 | 350 × 350 | 400 × 300 |
| | | 450 × 250 |

TABLE 2

| | | | Structure of Forming Device and Number of Forming Rolls Required (Rolls) (Number of rolls for manufacturing the product range of Table 1) | | | |
|---|---|---|---|---|---|---|
| | Forming Roll Caliber | Heating Prior To Forming (Mid-Frequency Induction Heating) | 4-Direction Roll Stands For Increasing Drive Force | 4-Direction Roll Stands For Square Tube Forming | 2-Direction Roll Stands For Square Tube Forming | Total |
| Former (1) | Single Curvature | No | 2 Stages | 4 Stages | — | 6 Stages |
| | | | 48 Rolls | 272 Rolls | — | 320 Rolls |
| Former (2) | Single Curvature | No | — | — | 60 Stages | 60 Stages |
| | | | — | — | 120 Rolls | 120 Rolls |
| Invention (1) | Consecutive Curvatures | No | — | 2 Stages | 8 Stages | 10 Stages |
| | | | — | 136 Rolls | 16 Rolls | 152 Rolls |
| Invention (2) | Consecutive Curvatures | Yes | — | — | 8 Stages | 8 Stages |
| | | | — | — | 16 Rolls | 16 Rolls |

The explanations above described forms of the execution of this invention, but the described forms of execution are nothing more than examples of execution of the invention. Accordingly, the invention is not limited to the described forms of execution, and it would be possible to execute by suitably varying the form of the described execution within a range that does not deviate from the objective.

This invention, as clarified in the embodiments, enables remarkable reduction of dependence on constriction of circumferential direction and localized rolling/compression on shoulder portions at the process final stage for finishing the objective product shape and dimensions, and alleviates problems of insufficient rigidity or toughness in corner portions and adjacent locations, improves reproducibility of the curvature of the corner portions and flatness of the side portions of the obtained square tube, and along with enabling manufacture of square tubes of high quality from round tubes, eliminates problems of compatibility between differing raw tube diameters and single caliber curvature radii in roll multi-use implementation, enables attainment of multi-use implementation of forming rolls greatly reduced in number of forming rolls and number of forming stages, and enables economical use of materials.

The invention claimed is:

1. A forming roll device for successively forming a raw tube with a circular cross section into a square tube with a square cross section or rectangular cross section, comprising:

at least an upper-lower forming roll pair and a left-right forming roll pair, each roll having a rotation axis, the rotation axis of each of said forming rolls is disposed within a plane that includes a cross section of said raw tube, wherein:

a surface of each of said forming rolls in the direction of its axis of rotation has a plurality of curvatures, said curvatures of the surface of each of said forming rolls are structured so that straightening of raw tube locations adjacent to sections scheduled to be a corner portion of the square tube precedes straightening of raw tube locations adjacent to sections scheduled to be a side portion of the square tube, a curvature of the surface of each of said forming rolls that constricts a raw tube location adjacent sections scheduled to be a corner portion of said square tube is smaller than a curvature of the surface of each of said forming rolls that constricts a raw tube location adjacent sections scheduled to become the side portion center of the square tube cross section, and a curvature of the surface of any of said forming rolls in the direction of the rotation axis becomes continuously or consecutively smaller toward both outer sides from a position on the surface of an of said forming rolls for constricting a raw tube location to become a side portion center of said square tube cross section.

2. A forming roll device as claimed in claim 1 wherein:

said upper-lower forming roll pairs and said left-right forming roll pairs are disposed in multiple stages, and each roll rotation axis for said upper-lower forming roll pair and said left-right forming roll pair of at least one stage is disposed within a plane that includes a raw tube cross section differing for each roll pair.

3. A forming method for successively forming a raw tube with a circular cross section into a square tube with a square cross section or rectangular cross section, comprising the steps of:

utilizing an upper-lower forming roll pair and left-right forming roll pair to reform said raw tube, each roll having a rotation axis, a surface of each of said forming rolls in the direction of its axis of rotation has a plurality of curvatures, said curvatures of the surface of each of said forming oils are structured so that straightening of raw tube locations adjacent to sections scheduled to be a corner portion of the square tube precedes straightening of raw tube locations adjacent to sections scheduled to be a side portion of the square tube, a curvature of the surface of each of said forming rolls that constricts a raw tube location adjacent sections scheduled to be a corner portion of said square tube is smaller than a curvature of the surface of each of said forming rolls that constricts a raw tube location adjacent sections scheduled to become the side portion center of the square tube cross section, and a curvature of the surface of the rolls that constricts a raw tube location scheduled to be a corner portion of said square tube is smaller than a curvature of the surface of the rolls that constricts a raw tube location adjacent sections scheduled to become the side portion center of the square tube cross section, and a curvature of the surface of any of said forming rolls in the direction of the rotation axis becomes continuously or consecutively smaller toward both outer sides from a position on the surface of any of said forming rolls for constricting a raw tube location to become a side portion center of said square tube cross section;

disposing the rotation axes of the roll pairs within a plane that includes a cross section of said raw tube, and disposing each roll rotation axis for one pair of said upper-lower forming roll and one pair of said left-right forming roll within a plane that includes a raw tube cross section differing for each roll pair.

4. A forming method for successively forming a raw tube with a circular cross section into a square tube with a square cross section or rectangular cross section according to claim 3, wherein the steps utilize multiple upper-lower forming roll pairs and multiple left-right forming roll pairs.

* * * * *